US007452307B2

(12) United States Patent
Chuang et al.

(10) Patent No.: US 7,452,307 B2
(45) Date of Patent: Nov. 18, 2008

(54) BALANCE-ENHANCING AND VIBRATION-REDUCING DEVICE FOR WRIST EXERCISER

(76) Inventors: Yun Yu Chuang, 4F, No. 16, Alley 15, Lane 82, Da Yong Street, San Chong City, Taipei (TW); Ming Hung Lin, 2F, No. 24, Lane 178, Li Shyng Road Section 1, San Chong City, Tapei (TW)

( * ) Notice: Subject to any disclaimer, the term of this patent is extended or adjusted under 35 U.S.C. 154(b) by 793 days.

(21) Appl. No.: 10/923,683

(22) Filed: Aug. 24, 2004

(65) Prior Publication Data

US 2005/0101440 A1 May 12, 2005

(30) Foreign Application Priority Data

Nov. 12, 2003 (TW) ..... 92220010 U

(51) Int. Cl.
*A63B 21/00* (2006.01)

(52) U.S. Cl. ..... 482/44; 482/45

(58) Field of Classification Search ..... 482/45–50, 482/8; 446/233; 473/570, 594, 595
See application file for complete search history.

(56) References Cited

U.S. PATENT DOCUMENTS 7,033,304 B2 * 4/2006 Chuang et al. ..... 482/45
2003/0129920 A1 * 7/2003 Sze ..... 446/233
2004/0048720 A1 * 3/2004 Kuo ..... 482/45
2005/0107218 A1 * 5/2005 Chuang et al. ..... 482/45

* cited by examiner

*Primary Examiner*—Jerome Donnelly
(74) *Attorney, Agent, or Firm*—Rosenberg, Klein & Lee

(57) ABSTRACT

A balance-enhancing and vibration-reducing device is incorporated in a wrist exerciser to enhance force balance and reduce vibration caused in the operation of the wrist exerciser. The device includes a ring mounted in a casing of the wrist exerciser and defining diametrically opposite holes that rotatably receive axles of a rotor of the wrist exerciser. A coupler is mounted to an inner circumference of the ring in position corresponding to at least one of the holes. The coupler includes a tube extending in a radial direction of the ring. The tube forms a central bore to rotatably receive the corresponding axle. A plurality of resilient pawls is formed at a free end of the tube and distributed along a circumference of the free end. A balance-enhancing and vibration-reducing element has a central bore fit over the tube of the coupler by elastically deforming the pawls. The pawls so deformed resume their original position by the resiliency thereof to retain the balance-enhancing and vibration-reducing element on the tube. The balance-enhancing and vibration-reducing element effects weight balance and absorption of mechanical vibration force during the rotation of the rotor thereby maintaining stable and noiseless operation of the wrist exerciser.

9 Claims, 10 Drawing Sheets

BALANCE-ENHANCING AND VIBRATION-REDUCING DEVICE FOR WRIST EXERCISER

BACKGROUND OF THE INVENTION

1. Field of the Invention

The present invention generally relates to a wrist exerciser that is held by a palm of a user and having an internal rotor that is caused to rotate by the user exercising his or her wrist muscles, and in particular to a device for enhancing force balance and reducing vibration caused by the operation of the wrist exerciser.

2. The Related Art

A wrist exerciser is employed to exercise and rehabilitate wrist-related muscles of a user. Apparent therapeutic result can be obtained in the user for rehabilitation purposes. Examples of the wrist exercisers are shown in Taiwan Utility Model No. 135058 and U.S. Pat. No. 5,800,311, both disclose wrist exercises in which wrist related muscles are well exercised by simply rotating the wrist exerciser with the wrist.

FIG. 10 of the attached drawings shows a conventional wrist exerciser, which is designated with reference character A, comprising a rotor A1 encased in a spherical casing constituted by upper and lower hemi-spherical casing members A2, A3. A circumferential groove A11 is defined around the rotor A1. A hole A12 is defined in the rotor A1 inside the groove A11. The upper casing member A2 defines an opening A21 substantially corresponding in position to the groove A11 for the extension of a rope B. The rope B is wound around the rotor A1 by being received in and extending along the groove A11. When the rope B is quickly withdrawn out of the rotor A1, the friction between the rope B and the rotor A1 causes the rotor A1 to rotate inside the casing.

The rotor A1 is rotatably supported inside the casing by two axles A13 extending from opposite sides of the rotor A1 in opposite directions. The axles A13 are rotatably received in holes (not shown) defined in the casing. The axles A13 is smaller in weight, diameter, and length than the rotor A1 itself, which leads to force unbalance during the rotation of the rotor A1. Further, the axles A13 may induce resonance due to the high speed and high torque rotation of the rotor A1, leading to significant vibration of the axles A13 and abrasion with the casing members A2, A3. This shortens the service life and also generates large noise. Further, the vibration makes it difficult for a player to firmly hold the wrist exerciser A during the operation of the wrist exerciser A. A11 these result in difficulty and inconvenience in operation.

Thus, it is desired to provide a wrist exerciser that overcomes the above deficiencies of the conventional wrist exercisers.

SUMMARY OF THE INVENTION

Thus, a primary objective of the present invention is to provide a wrist exerciser comprising a device to enhance force balance and reduce vibration caused by the operation of the wrist exerciser.

Another objective of the present invention is to provide a wrist exerciser comprising a device for eliminating or at least alleviating mechanical abrasion caused by the rotation of axles that supports the rotation of a rotor and the noise caused by the rotation of the axles.

To achieve the above objectives, in accordance with the present invention, there is provided a balance-enhancing and vibration-reducing device adapted to be incorporated in a wrist exerciser to enhance force balance and reduce vibration caused in the operation of the wrist exerciser. The balance-enhancing and vibration-reducing device comprises a ring mounted in a casing of the wrist exerciser and defining diametrically opposite holes that rotatably receive axles of a rotor of the wrist exerciser. A coupler is mounted to an inner circumference of the ring in position corresponding to at least one of the holes. The coupler comprises a tube extending in a radial direction of the ring. The tube forms a central bore to rotatably receive the corresponding axle. A plurality of resilient pawls is formed at a free end of the tube and distributed along a circumference of the free end. A balance-enhancing and vibration-reducing element has a central bore fit over the tube of the coupler by elastically deforming the pawls. The pawls so deformed resume their original position by the resiliency thereof to retain the balance-enhancing and vibration-reducing element on the tube. The balance-enhancing and vibration-reducing element effects weight balance and absorption of mechanical vibration force during the rotation of the rotor thereby maintaining stable and noiseless operation of the wrist exerciser.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
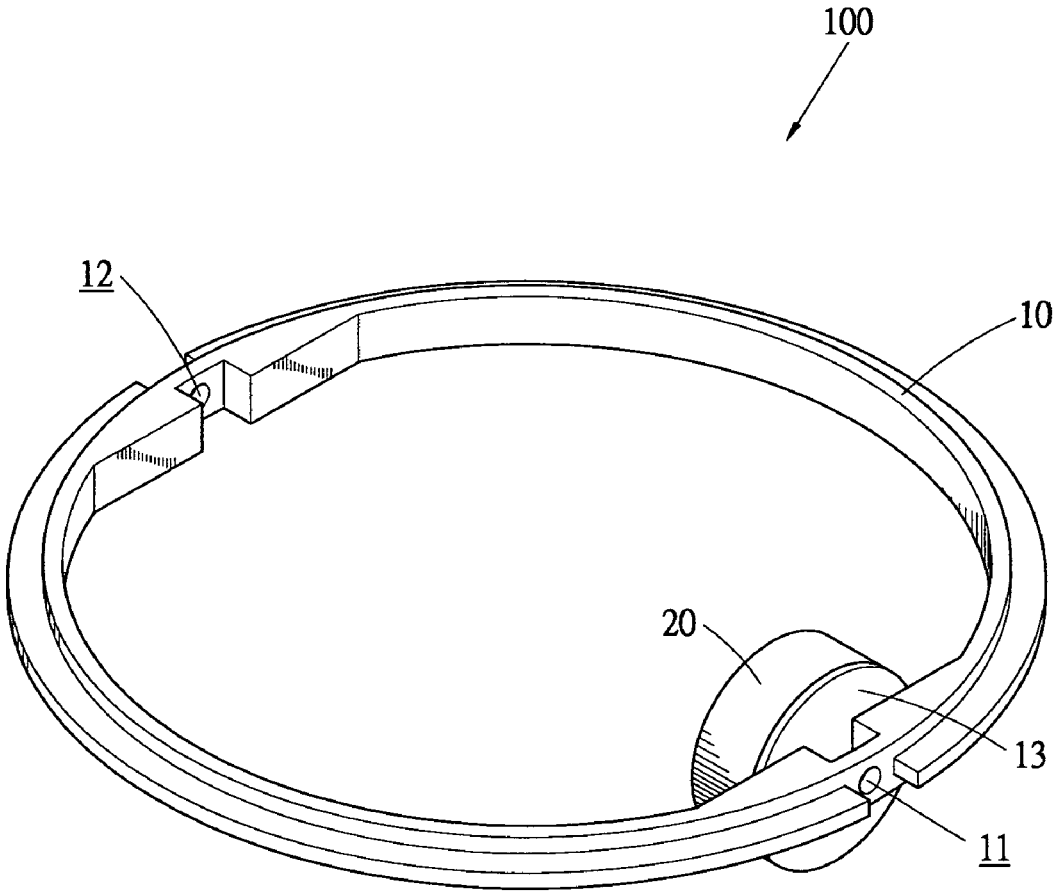
FIG. 1 is a perspective view of a balance-enhancing and vibration-reducing device for a wrist exerciser constructed in accordance with a first embodiment of the present invention.
Figure 2:
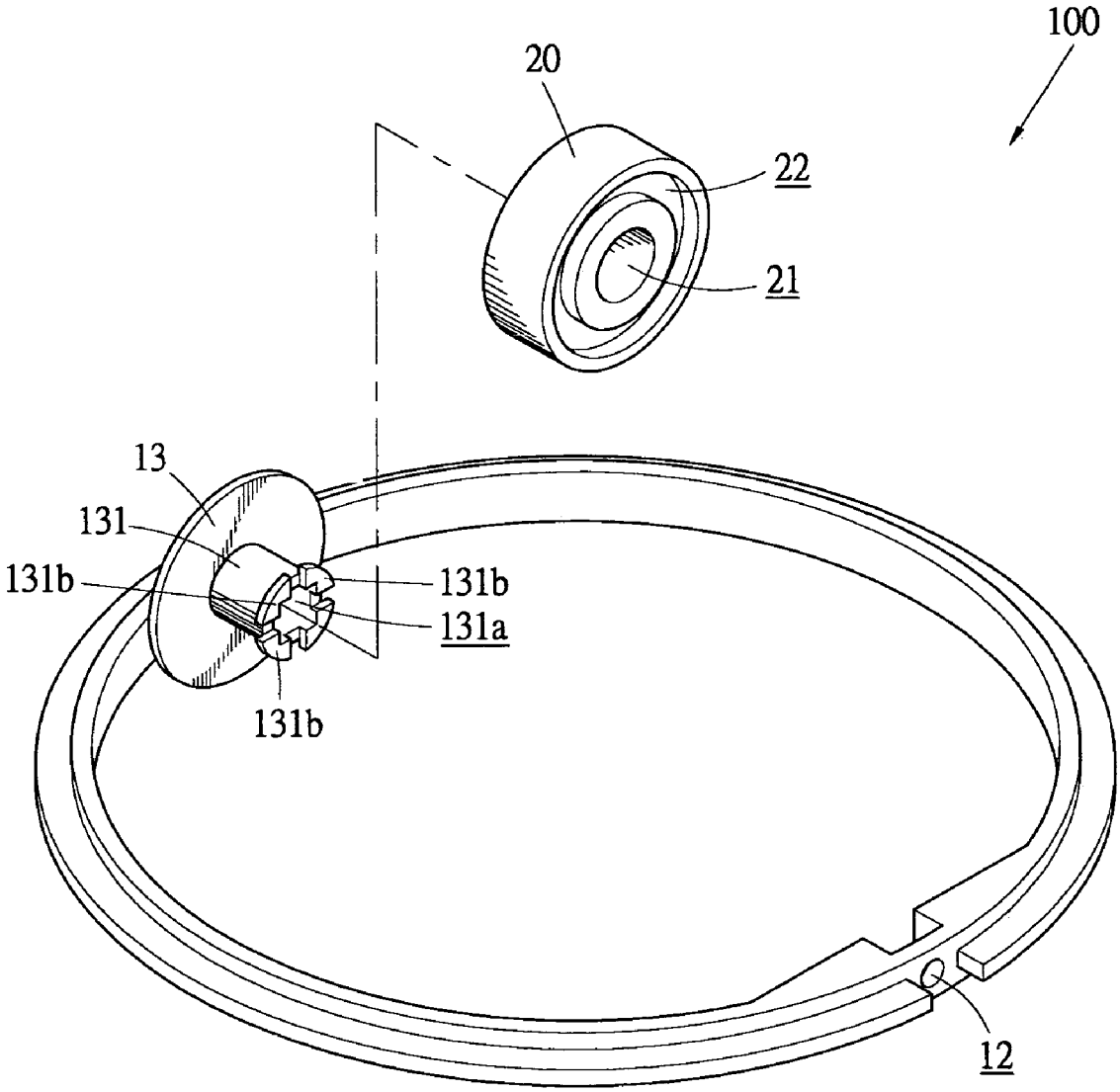
FIG. 2 is an exploded view of the balance-enhancing and vibration-reducing device of the present invention taken in different perspective.

With reference to the drawings and in particular to FIGS. 1 and 2, a balance-enhancing and vibration-reducing device constructed in accordance with the present invention, generally designated with reference numeral 100, is shown, which is to be incorporated in a wrist exerciser 200 (see FIG. 3) to enhance force balance and reduce vibration during the operation of the wrist exerciser 200. The balance-enhancing and vibration-reducing device 100 comprises a ring 10 sized to fix to a casing of the wrist exerciser 200 and a balance-enhancing and vibration-reducing element 20 mounted to the ring 10.

The ring 10 is made resilient and forms two diametrically opposite holes 11, 12. A coupler 13 is mounted to an inner circumference of the ring 10 at a position corresponding to the hole 11. The coupler 13 comprises a plate-like base (not labeled) from which a tube 131 extends in a radial direction of the ring 10 and defining a central bore 131*a* aligned to and communicating with the hole 11. A plurality of resilient pawls 131*b* is formed on a free end of the tube 131 and distributed along an outer circumference of the tube 131. Without being acted upon by external forces, the pawls 131*b* assume radially extending position with respect to the tube 131.

The balance-enhancing and vibration-reducing element 20 can be of any suitable shape, such as a ring as shown in FIGS. 1 and 2. The ring-shaped element 20 forms a central bore 21 fit over the tube 131 by deforming the pawls 131*b*. The pawls 131*b*, due to the resiliency thereof, resume the original, radially extending position after the balance-enhancing and vibration-reducing element 20 is completely fit over the tube 131 and thus retaining the ring-shaped balance-enhancing and vibration-reducing element 20 on the tube 131. Undesired detachment of the balance-enhancing and vibration-reducing element 20 from the tube 131 is prevented by the pawls 131*b*. It is apparent that the coupling between the ring-shaped balance-enhancing and vibration-reducing element 20 and the coupler 13 can be realized by other means, which will be further discussed in the following embodiments.

Figure 3:
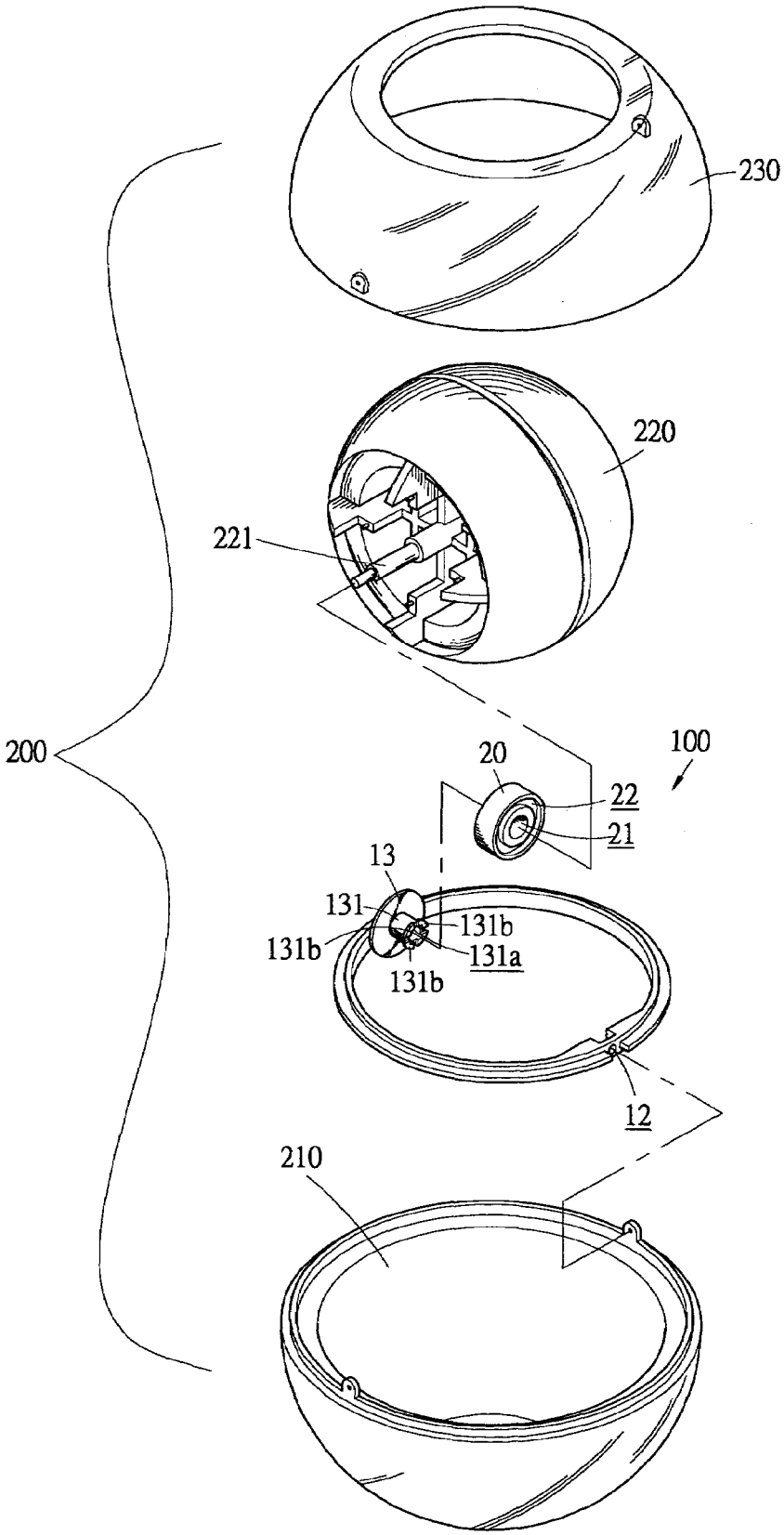
FIG. 3 is an exploded view of the wrist exerciser in which the balance-enhancing and vibration-reducing device of the present invention is incorporated.
Figure 4:
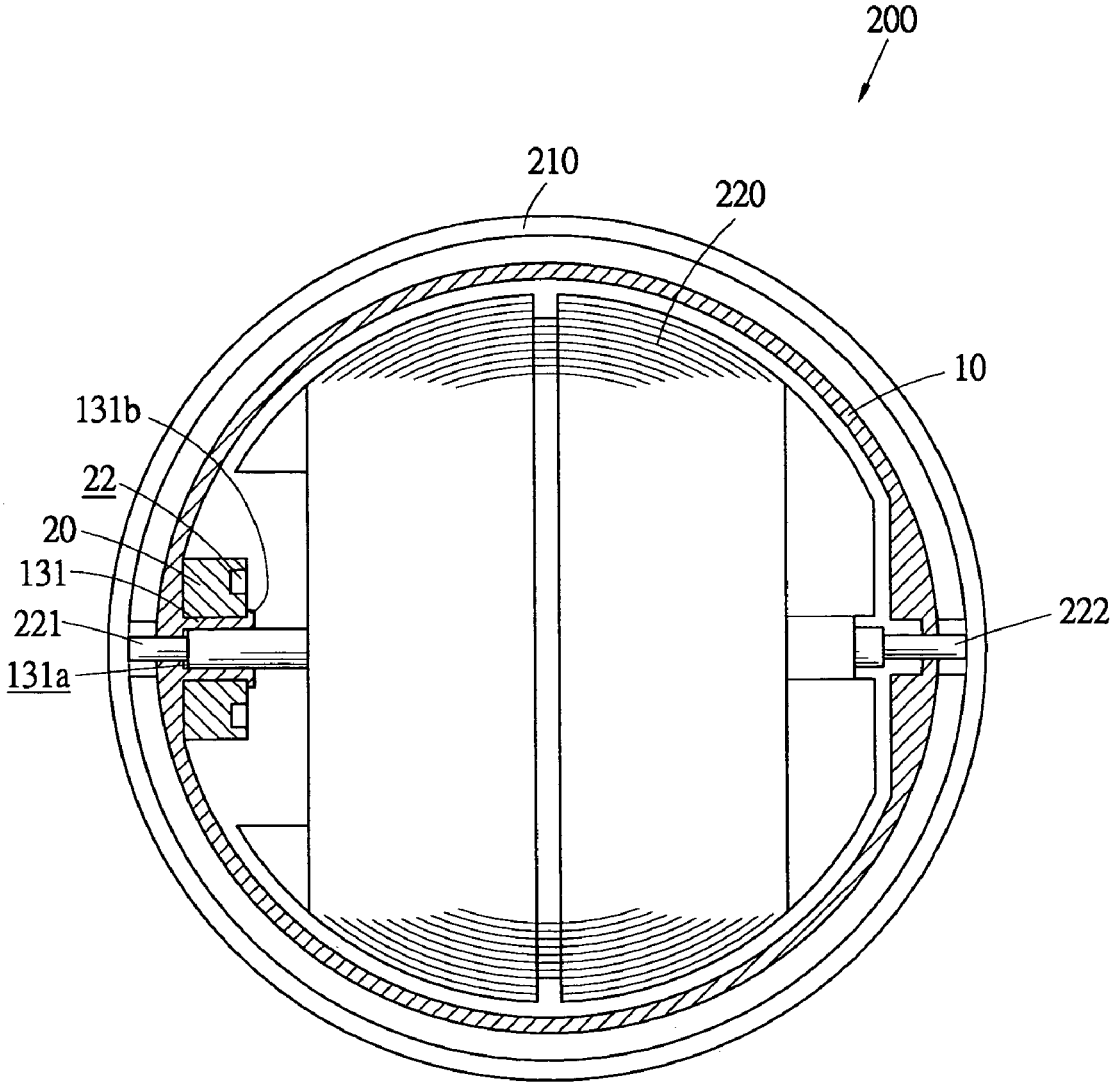
FIG. 4 is a cross-sectional view of the wrist exerciser shown in FIG. 3.

Also referring to FIGS. 3 and 4, a wrist exerciser, generally designated with reference numeral 200, incorporating the balance-enhancing and vibration-reducing device 100 of the present invention is shown. The wrist exerciser 200 comprises a substantially spherical casing (not labeled) constituted by upper and lower, semi-spherical casing members 210, 230 and a rotator 220 rotatably supported inside the casing. The ring 10 is sized to match and is thus mounted to an upper opening of the lower casing member 210. The rotor 220 has two axles 221, 222 respectively and rotatably fit into the holes 11, 12 of the ring 10. The first axle 221 extends through the central bore 131 a of the tube 131 to enter the hole 11 of the ring 10. By attaching the upper casing member 230 to the lower casing member 210, the rotor 10 is rotatably supported by the axles 221, 222 inside the casing.

The axle 221 is fit into the tube 131 of the coupler 13 to which the balance-enhancing and vibration-reducing element 20 is mounted. Due to the effect of the balance-enhancing and vibration-reducing device 100, the vibration of the axle 221 generated in the high-speed rotation or initial start-up of the rotor 220 is reduced and weight balance between the axle 221 and the rotor 220 is realized. Further the force caused by resonance of the rotor 220 in high-speed rotation is counteracted. In addition, noise caused by the rotation of the axles 221, 222 is eliminated. Mechanical abrasion between the axles 221, 222 and the upper and lower casing 210, 230 is reduced.

Figure 5:
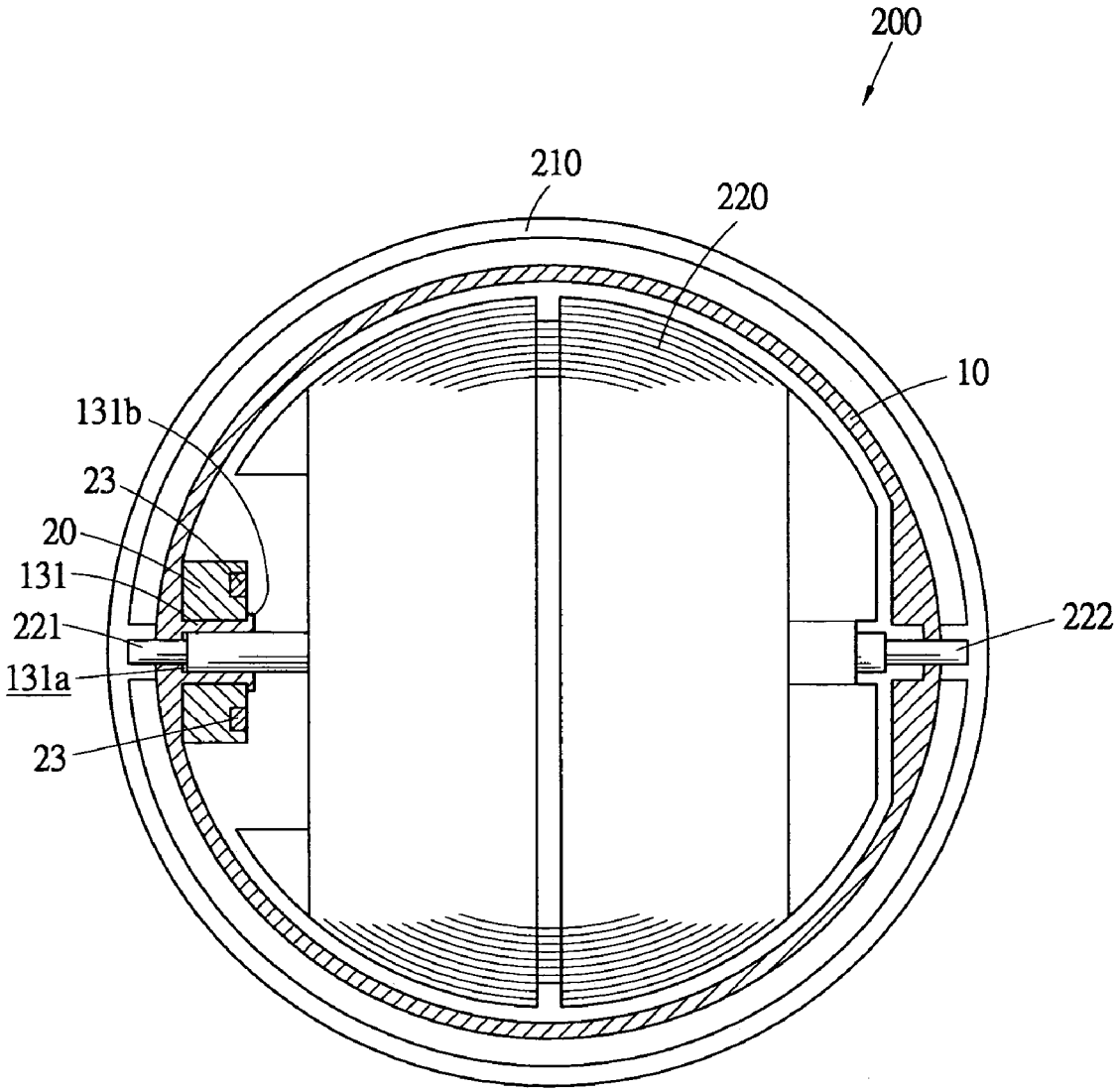
FIG. 5 is similar to FIG. 4 but showing a wrist exerciser in which a balance-enhancing and vibration-reducing device constructed in accordance with a second embodiment of the present invention is incorporated.

With reference to FIG. 5, a balance-enhancing and vibration-reducing device constructed in accordance with a second embodiment of the present invention, also designated with reference numeral 100 for simplicity, is shown. The balance-enhancing and vibration-reducing device 100 of the second embodiment comprises a ring-shaped balance-enhancing and vibration-reducing element 20 defining a central bore fit over the tube 131 of the coupler 13. An annular groove 22 is defined in an end face (not labeled) of the balance-enhancing and vibration-reducing element 20 to receive and retain therein a shock-absorbing element 23, which can be made of rubber, metal or magnetic material and thus can be selectively made different in weight to match different specifications of the wrist exerciser 200 whereby optimum effect of balance enhancement and vibration reduction can be realized. The shock-absorbing element 23 provides additional effect in balance enhancement and vibration reduction. Thus, the provision of the shock-absorbing element 23 allows the balance-enhancing and vibration-reducing device 100 to be used with different rotor 220 and casing.

Figure 6:
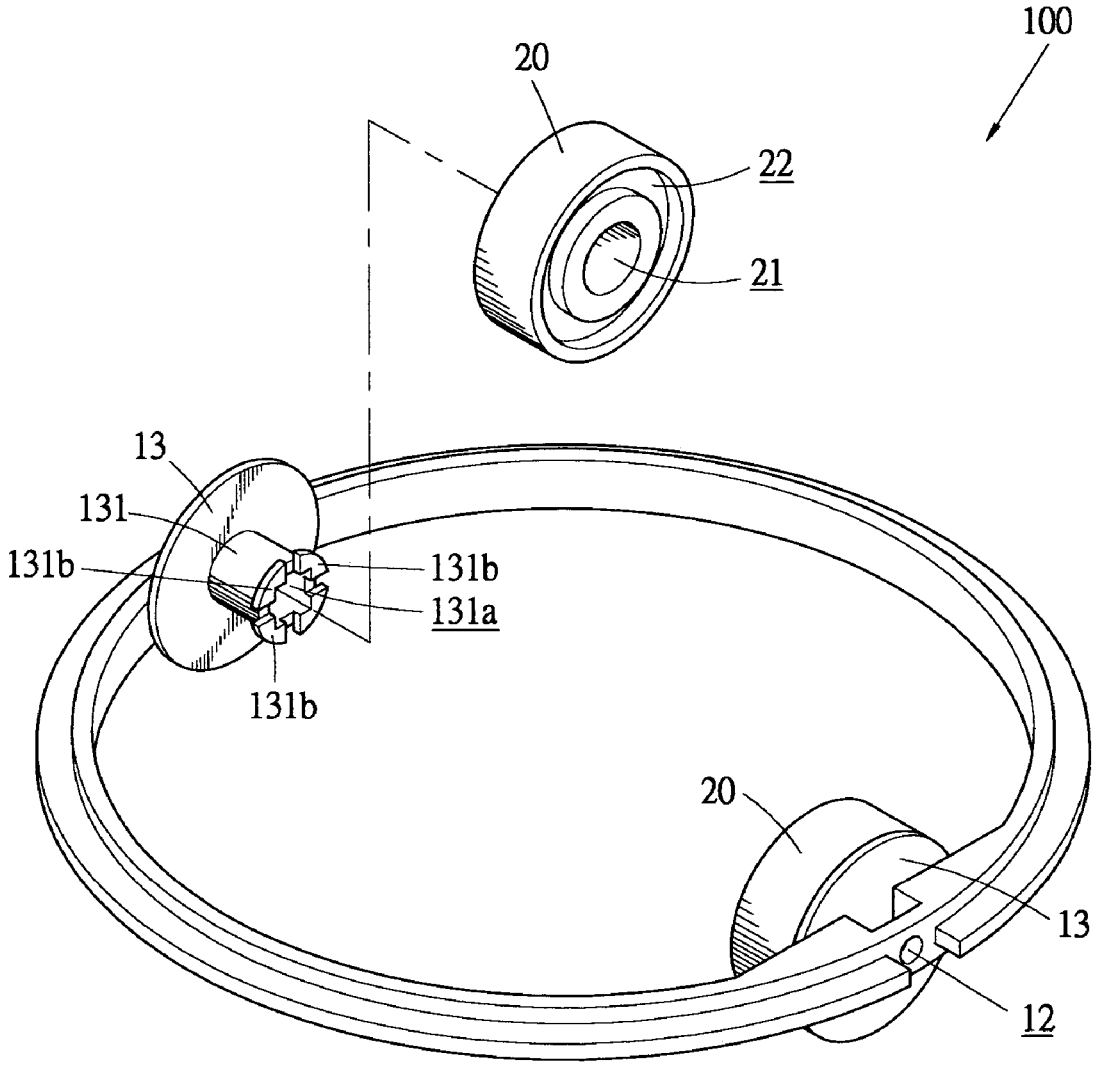
FIG. 6 is a perspective view of a balance-enhancing and vibration-reducing device constructed in accordance with a third embodiment of the present invention.

Also referring to FIG. 6, a balance-enhancing and vibration-reducing device constructed in accordance with a third embodiment of the present invention, also designated with reference numeral 100 for simplicity, is shown. The balance-enhancing and vibration-reducing device 100 of the third embodiment comprises a coupler 13 mounted to the ring 10 in positions corresponding to each of the holes 11, 12 and each coupler 13 forms a tube 131 defining a central bore 131*a* and having radially-extending resilient pawls 131*b*. A balance-enhancing and vibration-reducing element 20, which is in the form of a ring in the embodiment illustrated, is mounted to each coupler 13 by fitting over the tube 131. Thus, the axles 221, 222 of the rotor 220 are both fit into the tubes 131 to which the balance-enhancing and vibration-reducing elements 20 are mounted. The effect of balance enhancement and vibration reduction is realized in both axles 221, 222 of the rotor 220. Thus, overall effect of balance enhancement and vibration reduction is further improved.

Figure 7:
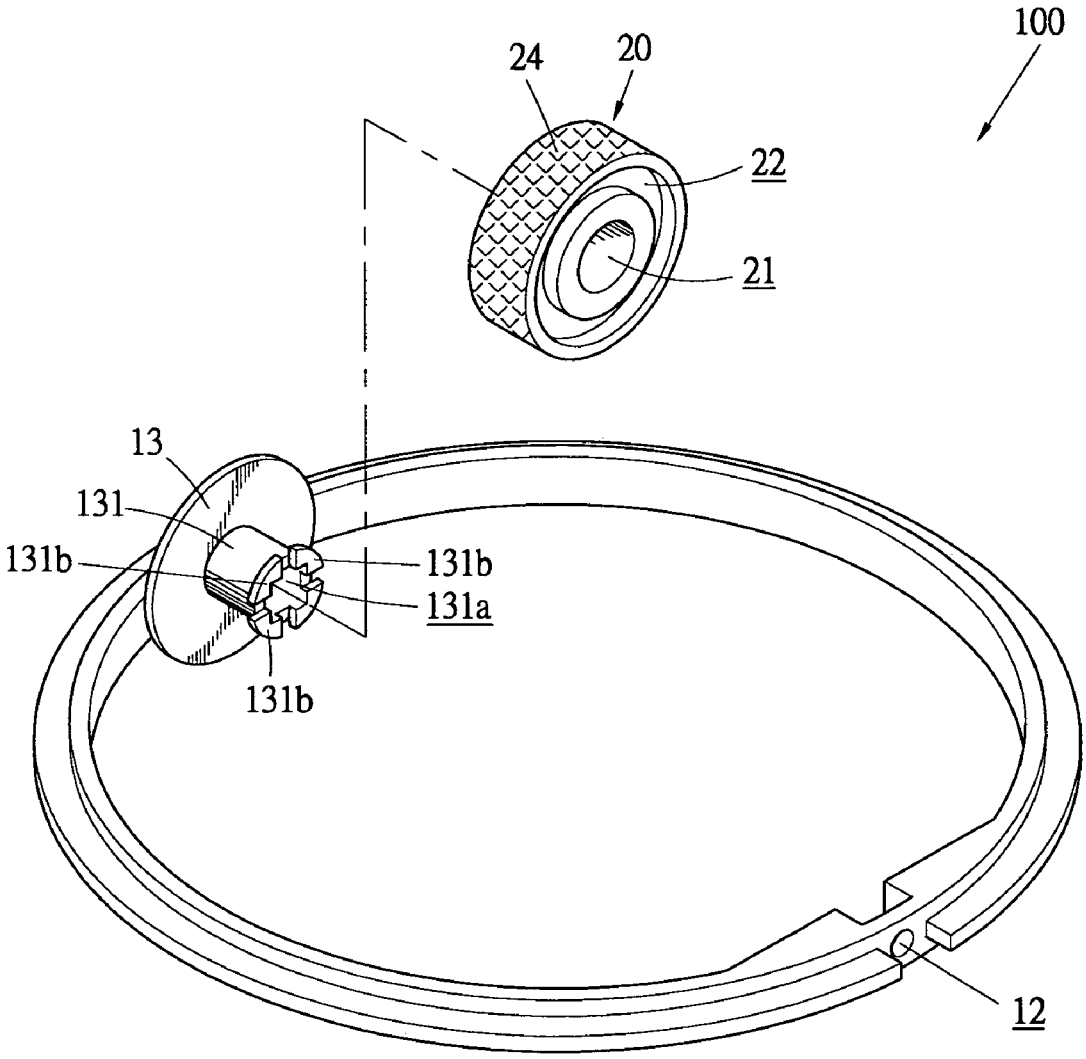
FIG. 7 is a perspective view of a balance-enhancing and vibration-reducing device constructed in accordance with a fourth embodiment of the present invention.

Also referring to FIG. 7, a balance-enhancing and vibration-reducing device constructed in accordance with a fourth embodiment of the present invention, also designated with reference numeral 100 for simplicity, is shown. The balance-enhancing and vibration-reducing device 100 of the fourth embodiment comprises a ring-shaped balance-enhancing and vibration-reducing element 20 having a circumferential surface on which projections 24 are formed, which increases the overall area for reducing vibration. Thus, the overall effect of balance enhancement and vibration reduction is further improved.

Figure 8:
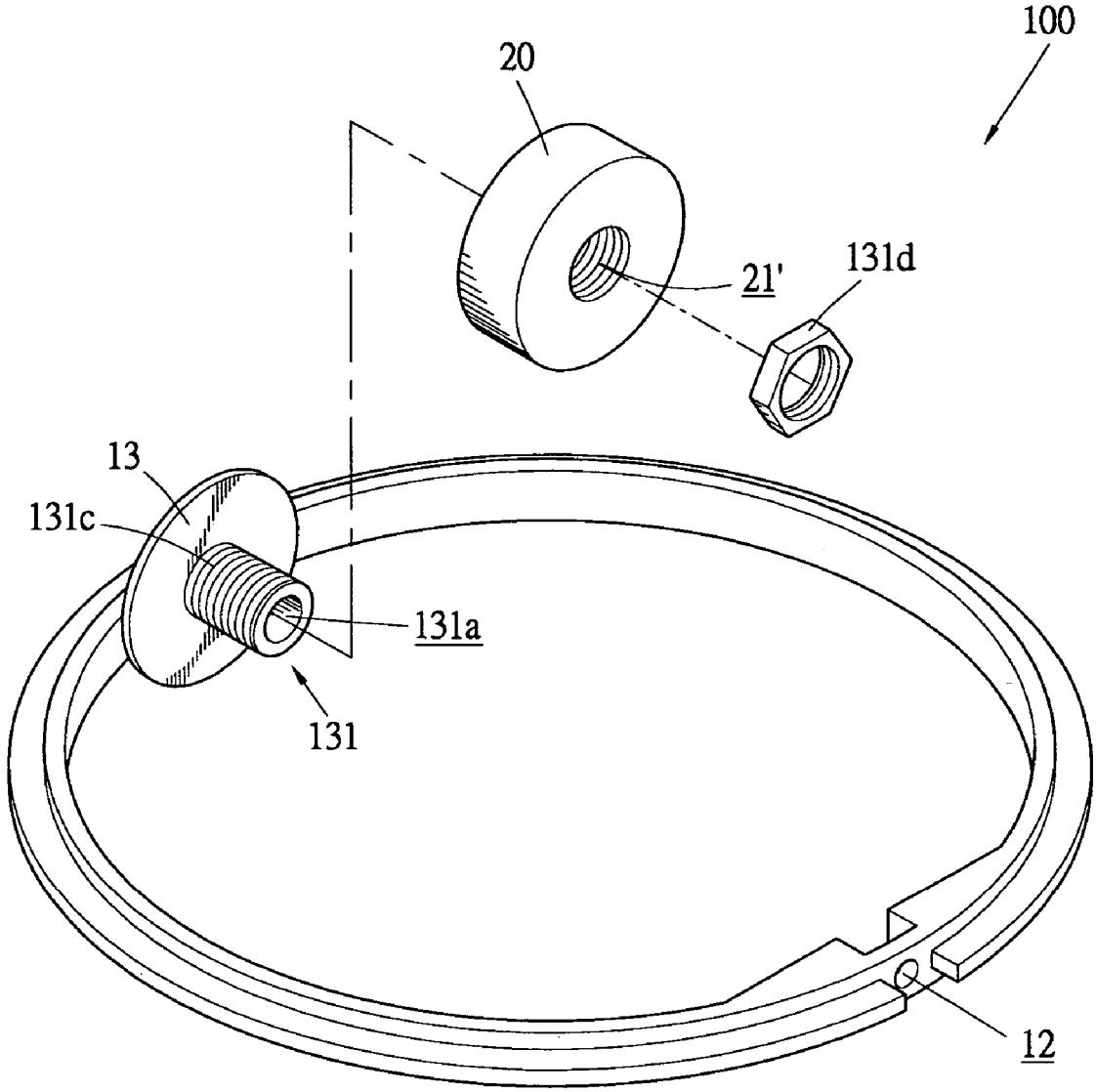
FIG. 8 is a perspective view of a balance-enhancing and vibration-reducing device constructed in accordance with a fifth embodiment of the present invention.

Also referring to FIG. 8, a balance-enhancing and vibration-reducing device constructed in accordance with a fifth embodiment of the present invention, also designated with reference numeral 100 for simplicity, is shown. The balance-enhancing and vibration-reducing device 100 of the fifth embodiment comprises a coupler 13 forming a tube 131 having an external threading 131*c* and a ring-shaped balance-enhancing and vibration-reducing element 20 defining an inner-threaded central bore 21' engaging the tube 131. A nut 131*d* mates the external threading 131*c* of the tube 131 to further secure the balance-enhancing and vibration-reducing element 20 in position.

Figure 9:
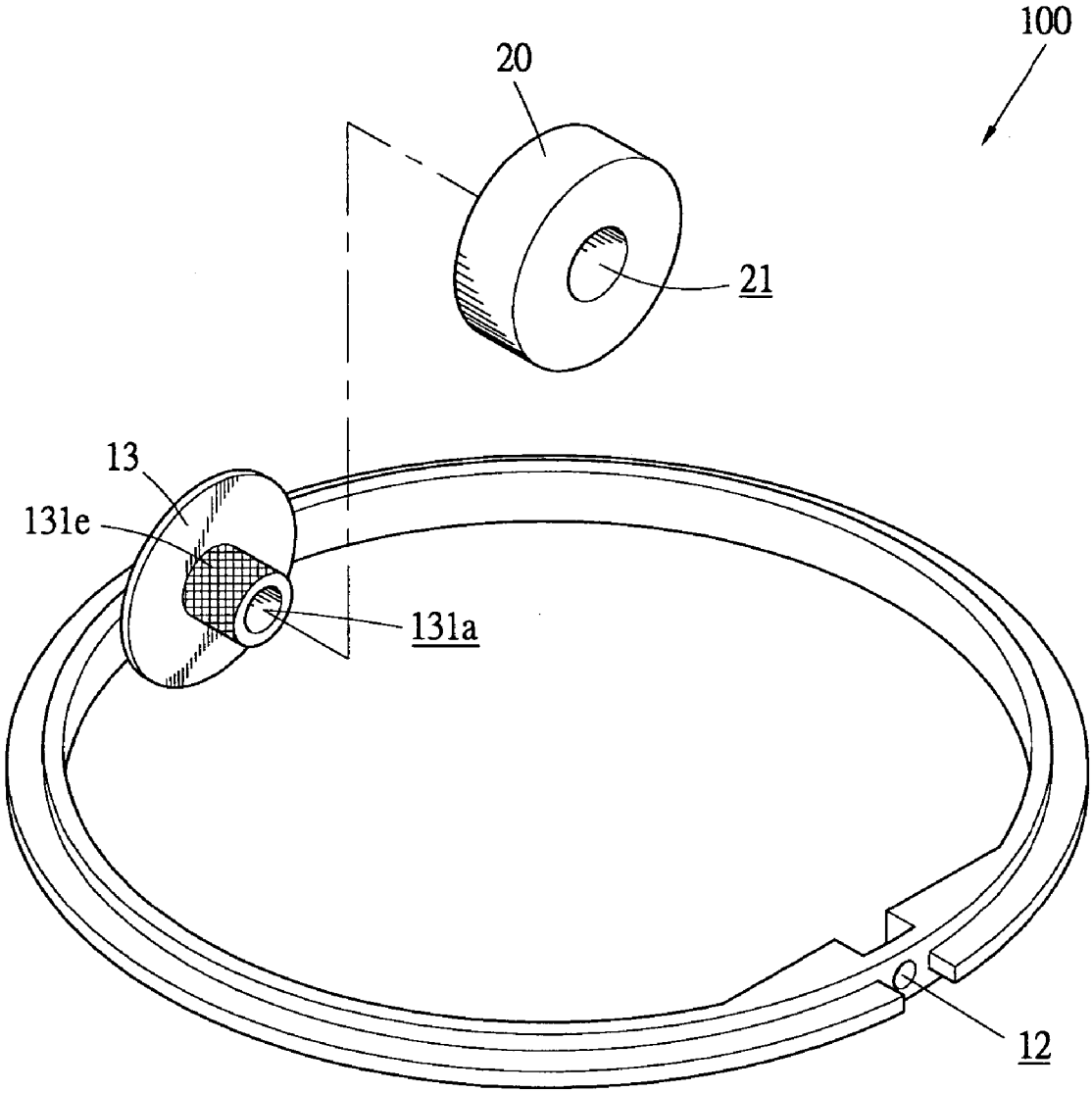
FIG. 9 is a perspective view of a balance-enhancing and vibration-reducing device constructed in accordance with a sixth embodiment of the present invention.
Figure 10:
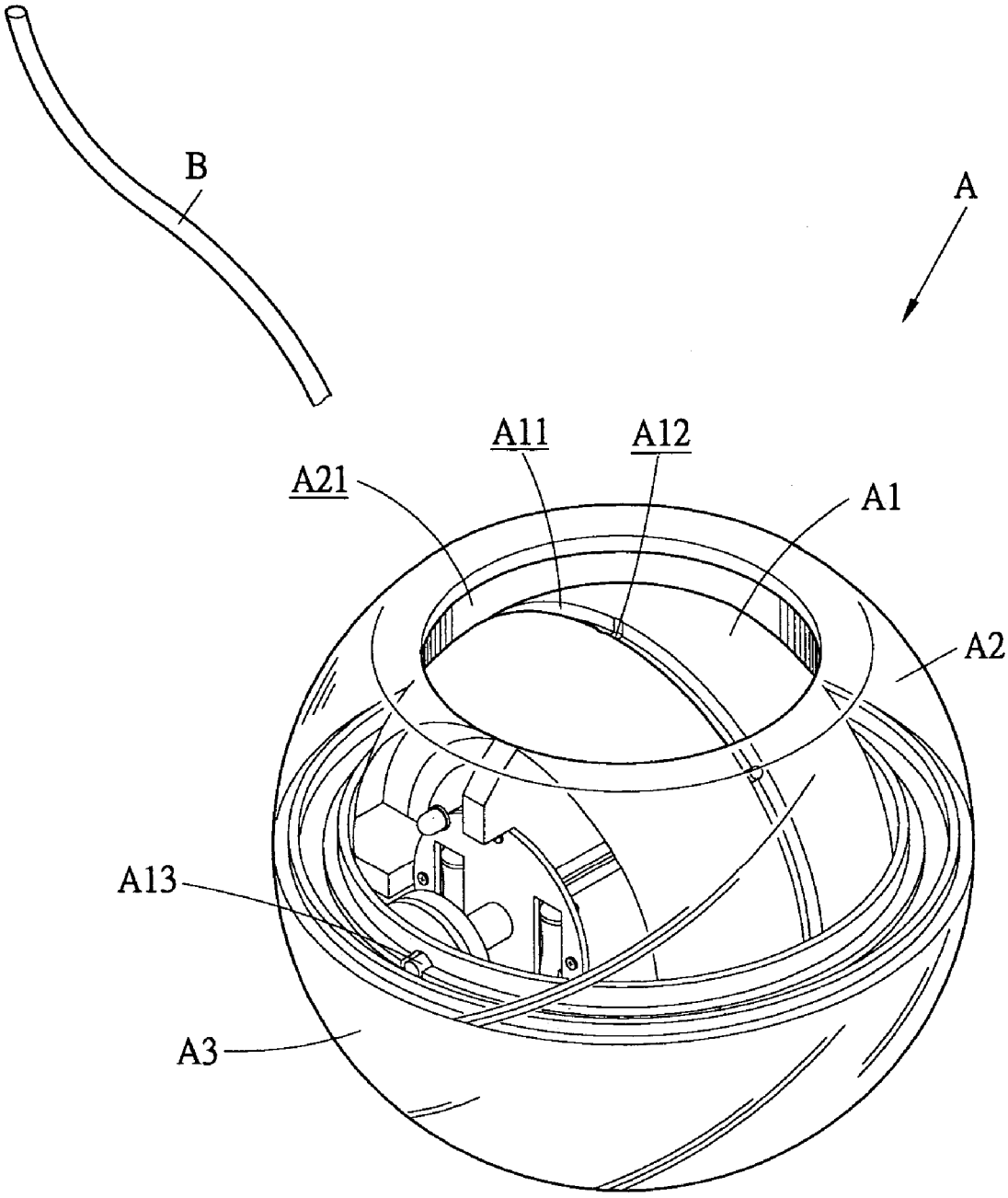
FIG. 10 is a perspective view of a conventional wrist exerciser.

Also referring to FIG. 9, a balance-enhancing and vibration-reducing device constructed in accordance with a sixth embodiment of the present invention, also designated with reference numeral 100 for simplicity, is shown. The balance-enhancing and vibration-reducing device 100 of the sixth embodiment comprises a coupler 13 forming a tube having a circumferential outer surface on which a layer of adhesive 131*e* is coated and a ring-shaped element 20 defining an central bore 21 is fit over the adhesive layer 131*e* and thus secured in position on the tube by the adhesive.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A balance-enhancing and vibration-reducing device adapted to be mounted in a wrist exerciser comprising a casing and a rotor rotatably supported inside the casing by opposite axles, the balance-enhancing and vibration-reducing device comprising:

a ring mounted in the casing and defining diametrically opposite holes that rotatably receive the axles of the rotor;

a coupler mounted to an inner circumference of the ring in position corresponding to at least one of the holes; and a balance-enhancing and vibration-reducing element mounted to the coupler;

wherein the coupler includes a tube and the balance-enhancing and vibration-reducing element form a central bore fit over the tube.

2. The balance-enhancing and vibration-reducing device as claimed in claim 1, wherein the tube defines a central bore for receiving the corresponding one of the axles of the rotor.

3. The balance-enhancing and vibration-reducing device as claimed in claim 1, wherein a plurality of resilient pawls is formed on a free end of the tube and distributed along a circumference of the free end of the tube for retaining the balance-enhancing and vibration-reducing element on the tube.

4. The balance-enhancing and vibration-reducing device as claimed in claim 1, wherein the tube comprises a circumferential surface on which threading is formed and wherein the central bore of the balance-enhancing and vibration-reducing element is internally threaded to engage the threading of the tube.

5. The balance-enhancing and vibration-reducing device as claimed in claim 4 further comprising a nut mating the threading of the tube to secure the balance-enhancing and vibration-reducing element on the tube.

6. The balance-enhancing and vibration-reducing device as claimed in claim 1, wherein the tube has a circumferential surface on which a layer of adhesive is coated, the balance-enhancing and vibration-reducing element being fit over the adhesive-coated tube and secured thereto by the adhesive.

7. The balance-enhancing and vibration-reducing device as claimed in claim 1, wherein the balance-enhancing and vibration-reducing element has an end face in which an annular groove is defined.

8. The balance-enhancing and vibration-reducing device as claimed in claim 7 further comprising a shock-absorbing element received and retained in the annular groove.

9. The balance-enhancing and vibration-reducing device as claimed in claim 1, wherein the balance-enhancing and vibration-reducing element has an outer surface on which projections are formed.

* * * * *